US005819763A

United States Patent [19]

Hallowell, II

[11] Patent Number: 5,819,763

[45] Date of Patent: Oct. 13, 1998

[54] MICROWAVABLE HAIR CURLERS

[76] Inventor: Robert L. Hallowell, II, 514 Museum Dr., Los Angeles, Calif. 90065

[21] Appl. No.: 837,784

[22] Filed: Apr. 22, 1997

[51] Int. Cl.[6] ..... A45D 2/20

[52] U.S. Cl. ..... 132/247; 132/245; 132/246; 219/222

[58] Field of Search ..... 132/247, 246, 132/269, 271, 233, 232, 229, 245; 219/222, 225, 242

[56] References Cited

U.S. PATENT DOCUMENTS

| | | | |
|---|---|---|---|
| 4,538,630 | 9/1985 | Henderson | 132/229 |
| 4,572,221 | 2/1986 | Barradas | 132/246 |
| 4,577,647 | 3/1986 | Fenster et al. | 123/246 |
| 4,710,609 | 12/1987 | Switlicki | 132/229 |
| 5,025,816 | 6/1991 | Jones | 132/247 |
| 5,372,152 | 12/1994 | Dutch | 132/247 |

*Primary Examiner*—Gene Mancene
*Assistant Examiner*—Pedro Philogene
*Attorney, Agent, or Firm*—Robert M. Sperry

[57] ABSTRACT

An improved hair curling device comprising a strip of fabric having a central portion containing a cushion formed of resilient material, such as foam rubber, and having a central core formed of microwave-heatable material.

8 Claims, 1 Drawing Sheet

MICROWAVABLE HAIR CURLERS

FIELD OF INVENTION

This invention relates to hair care products and is particularly directed to improved hair curlers which can be heated in a microwave oven.

PRIOR ART

Hair curling devices have been popular for many years and numerous types of hair curling device have been proposed heretofore. Many of the prior art hair curling devices have been rigid devices which were uncomfortable to wear, especially during sleeping. Other prior art hair curling devices have been formed of delicate material which night be attractive to observe, but which was not long lasting and would not tolerate washing or heating. The vast majority of prior art hair curling devices have been formed of material which could not withstand heating, although it is well known that heated hair curling devices are significantly more effective. Furthermore, many of the prior art hair curling devices have employed electrical heating means. However, this involves the risk of electrical shock to the user and greatly limits the user's mobility, since such electrically heated hair curling devices must usually be connected y an electrical cord to a source of electricity, which, essentially, places the user on a leash until the heating process has been completed. Thus, none of the prior art hair curling devices have been entirely satisfactory.

BRIEF SUMMARY AND OBJECTS OF INVENTION

These disadvantages of the prior art are overcome with the present invention and an improved hair curling device is provided which is soft and comfortable to wear, even when sleeping, and which is long lasting and durable, yet which can readily and conveniently be heated and which allows the user full mobility during use.

These advantages of the present invention are preferably attained by providing an improved hair curling device.

Accordingly, it is an object of the present invention to provide an improved hair curling device.

Another object of the present invention is to provide an improved hair curling device which is soft and comfortable to wear.

An additional object of the present invention is to provide an improved hair curling device which is soft and comfortable to wear even when sleeping.

A further object of the present invention is to provide an improved hair curling device which is long lasting and durable.

Another object of the present invention is to provide an improved hair curling device which can readily and conveniently be heated.

An additional object of the present invention is to provide an improved hair curling device which allows the user full mobility during use.

A specific object of the present invention is to provide an improved hair curling device comprising a strip of fabric having a central portion containing a cushion formed of resilient material, such as foam rubber, and having a central core formed of microwave-heatable material.

These and other objects and features of the present invention will be apparent from the following detailed description, taken with reference to the figures of the accompanying drawing.

DETAILED DESCRIPTION OF THE INVENTION

Figure 1:
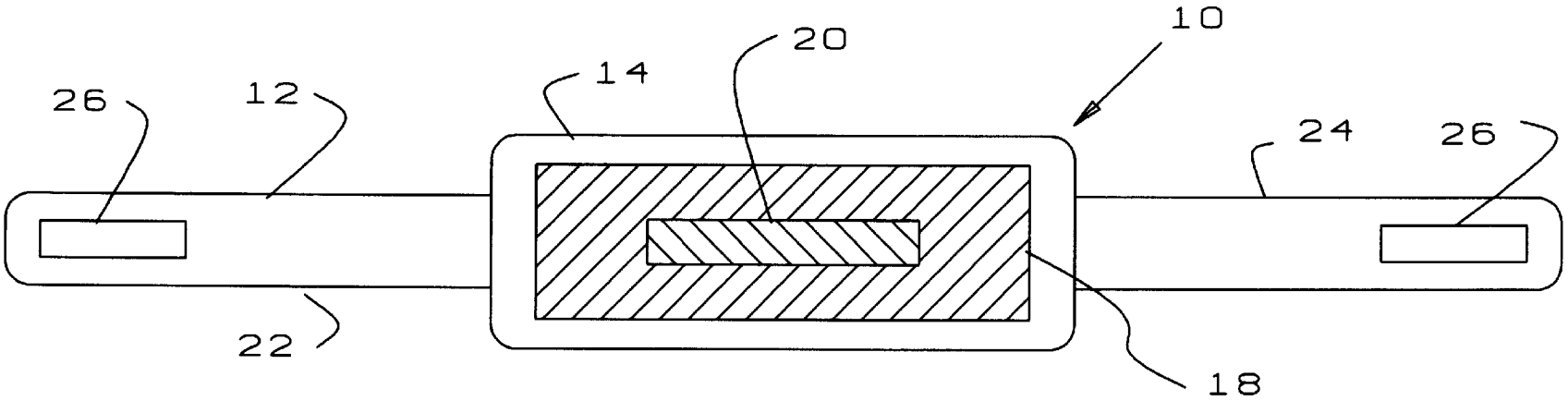
FIG. 1 is a view, partly in section, showing a hair curling device embodying the present invention.

In that form of the present invention chosen for purposes of illustration, FIG. 1 shows a hair curling device, indicated generally at 10, comprising a strip 12 of fabric having a central portion 14 containing a cushion 18 formed of resilient material, such as foam rubber, polyurethane foam, and the like, surrounding a central core member 20 formed of microwave-heatable material. The strip 12 has end portions 22 and 24 extending from each end of the central portion 14 which can be tied together to secure a quantity of hair. Alternatively, if desired, non-metallic releasable fastening means 26, such as patches of hook-and-loop material, may be provided on the end portions 22 and 24 to facilitate securing the end portions 22 and 24 together.

In use, the hair curling device 10 may be placed in a microwave oven and heated to a desired temperature prior to use. This causes the central core member 20 to become heated and to retain this heat for a considerable length of time. When satisfactorily heated, the hair curling device 10 may be removed from the oven and a strand of hair may be wound about the central portion 14 and, hence, about the cushion 18 and the heated central core member 20. Finally, the end portions 22 and 24 may be fastened, by tying or by means of the releasable fastening means 26 to retain the hair curling device 10 in operative contact with the strand of hair. Since no electricity is required, there is nothing to limit the mobility of the user while the hair is being curled. Subsequently, when desired, the end portions 22 and 24 may be released and the hair curling device 10 can be removed.

Obviously, numerous variations and modifications can be made without departing from the spirit of the present invention. Therefore, it should be clearly understood that the forms of the present invention chosen for purposes of illustration in the drawing are illustrative only and are not intended to limit the scope of the present invention.

What is claimed is:

1. A hair curler device comprising:

a strip of fabric having a central portion, a cushion formed of resilient material located within said central portion, and a central core member formed of microwave-heatable material located within said central portion.

2. The hair curler of claim 1 wherein:

said central core member is surrounded by said cushion.

3. The hair curler of claim 1 wherein:

said cushion is formed of foam rubber.

4. The hair curler of claim 1 wherein:

said cushion is formed of polyurethane foam.

5. The hair curler of claim 1 wherein:

said strip of fabric has end portions extending from each end of said central portion.

6. The hair curler of claim 5 wherein:

releasable fastening means are mounted on each of said end portions.

7. The hair curler of claim 6 wherein:

said releasable fastening means are non-metallic.

8. The hair curler of claim 7 wherein:

said releasable fastening means are patches of hook-and-loop material.

* * * * *